US007423611B2

(12) United States Patent
Ooe et al.

(10) Patent No.: US 7,423,611 B2
(45) Date of Patent: Sep. 9, 2008

(54) DISPLAY DEVICE CAPABLE OF CONTROLLING POWER CONSUMPTION WITHOUT GENERATING DEGRADATION IN IMAGE QUALITY, AND METHOD OF DRIVING THE DISPLAY DEVICE

(75) Inventors: Takayuki Ooe, Kawasaki (JP); Toshio Ueda, Kawasaki (JP); Kosaku Toda, Kawasaki (JP)

(73) Assignee: Fujitsu Hitachi Plasma Display Limited, Kawasaki (JP)

( * ) Notice: Subject to any disclaimer, the term of this patent is extended or adjusted under 35 U.S.C. 154(b) by 461 days.

(21) Appl. No.: 10/107,319

(22) Filed: Mar. 28, 2002

(65) Prior Publication Data

US 2003/0030655 A1 Feb. 13, 2003

(30) Foreign Application Priority Data

Aug. 8, 2001 (JP) ..... 2001-241330

(51) Int. Cl.
*G09G 3/28* (2006.01)
*G09G 3/10* (2006.01)

(52) U.S. Cl. ..... 345/60; 345/37; 345/41

(58) Field of Classification Search ..... 345/211, 345/212, 37, 60, 63, 41
See application file for complete search history.

(56) References Cited

U.S. PATENT DOCUMENTS 5,956,014 A 9/1999 Kuriyama et al.
6,278,421 B1 8/2001 Ishida et al.
6,326,938 B1 12/2001 Ishida et al.

FOREIGN PATENT DOCUMENTS

| | | |
|---|---|---|
| EP | 0 945 845 A2 | 9/1988 |
| EP | 0 762 373 A2 | 3/1997 |
| EP | 0 841 652 A1 | 5/1998 |
| EP | 1 065 645 A2 | 1/2001 |
| JP | 6-332397 | 12/1994 |
| JP | 10-187084 | 7/1998 |
| JP | 11-282396 | 10/1999 |
| JP | 2001-75530 | 3/2001 |
| WO | WO 00/17845 | 3/2000 |

OTHER PUBLICATIONS

Japanese Patent Office Action, mailed May 20, 2008 and issued in corresponding Japanese Patent Application No. 2002-074418.

*Primary Examiner*—Sumati Lefkowitz
*Assistant Examiner*—Srilakshmi K Kumar
(74) *Attorney, Agent, or Firm*—Staas & Halsey LLP

(57) ABSTRACT

A method of driving a display device has a calculating step, a comparing step, and a controlling step. The calculating step calculates a total number of light-emission pulses within a field, based on an average of display load factors in at least two fields, the comparing step compares the calculated number of light-emission pulses with a number of light-emission pulses based on power consumption, and the controlling step controls a smaller display load factor as the total number of light-emission pulses within a field.

10 Claims, 9 Drawing Sheets

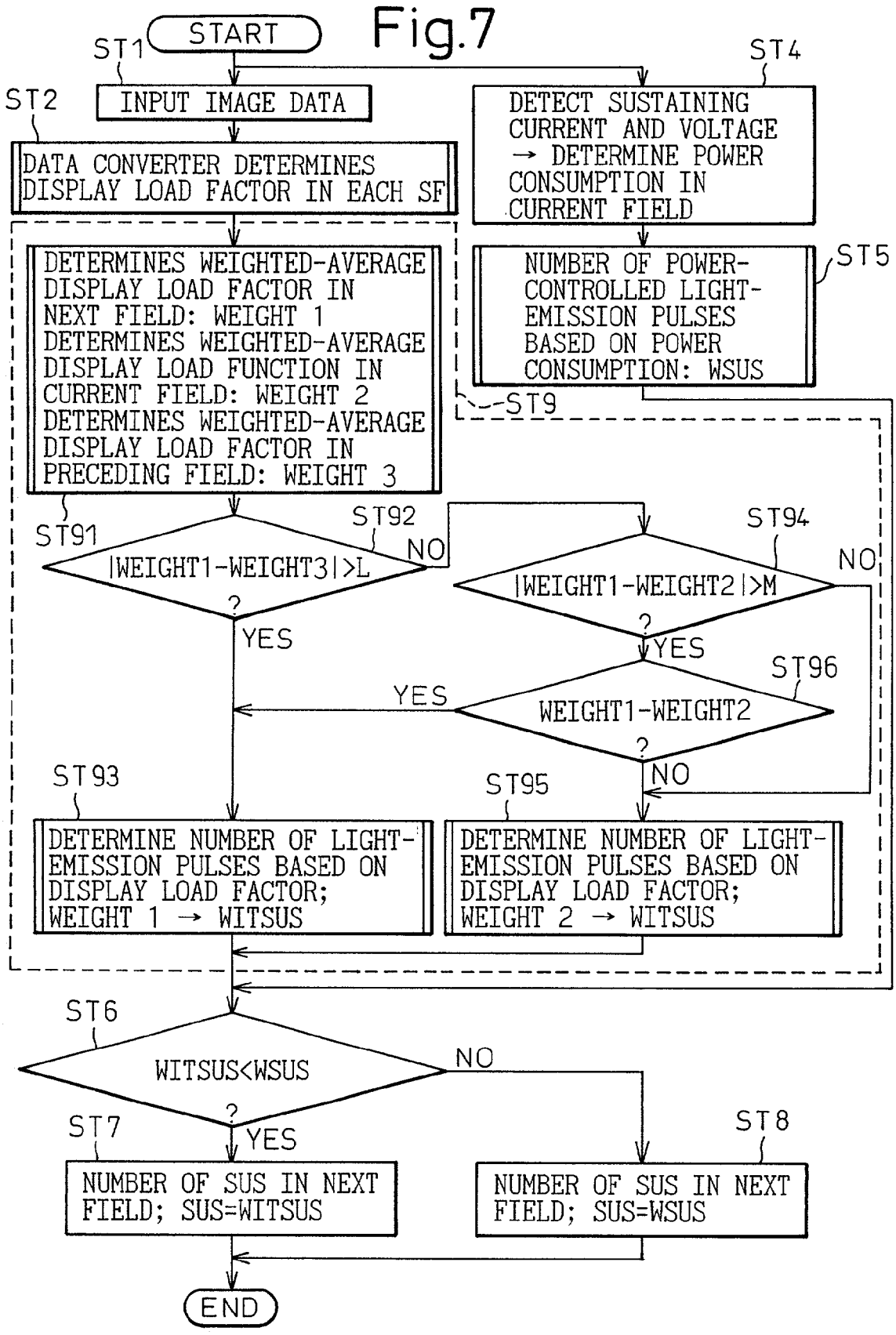
Fig.7
START
ST1
INPUT IMAGE DATA
ST2
DATA CONVERTER DETERMINES DISPLAY LOAD FACTOR IN EACH SF
ST4
DETECT SUSTAINING CURRENT AND VOLTAGE → DETERMINE POWER CONSUMPTION IN CURRENT FIELD
ST5
NUMBER OF POWER-CONTROLLED LIGHT-EMISSION PULSES BASED ON POWER CONSUMPTION: WSUS
ST9
DETERMINES WEIGHTED-AVERAGE DISPLAY LOAD FACTOR IN NEXT FIELD: WEIGHT 1
DETERMINES WEIGHTED-AVERAGE DISPLAY LOAD FUNCTION IN CURRENT FIELD: WEIGHT 2
DETERMINES WEIGHTED-AVERAGE DISPLAY LOAD FACTOR IN PRECEDING FIELD: WEIGHT 3
ST91
ST92
|WEIGHT1-WEIGHT3|>L ?
NO
YES
ST94
|WEIGHT1-WEIGHT2|>M ?
NO
YES
ST96
WEIGHT1-WEIGHT2 ?
YES
NO
ST93
DETERMINE NUMBER OF LIGHT-EMISSION PULSES BASED ON DISPLAY LOAD FACTOR; WEIGHT 1 → WITSUS
ST95
DETERMINE NUMBER OF LIGHT-EMISSION PULSES BASED ON DISPLAY LOAD FACTOR; WEIGHT 2 → WITSUS
ST6
WITSUS<WSUS ?
NO
YES
ST7
NUMBER OF SUS IN NEXT FIELD; SUS=WITSUS
ST8
NUMBER OF SUS IN NEXT FIELD; SUS=WSUS
END

DISPLAY DEVICE CAPABLE OF CONTROLLING POWER CONSUMPTION WITHOUT GENERATING DEGRADATION IN IMAGE QUALITY, AND METHOD OF DRIVING THE DISPLAY DEVICE

BACKGROUND OF THE INVENTION

1. Field of the Invention

The present invention relates to a display device and a method of driving the same. More particularly, the present invention relates to a display device that has a plurality of light-emission blocks constructed of a plurality of light-emission pulses within each field of a plasma display panel (PDP) and that displays an intermediate gradation based on a combination of the light-emission blocks, and further, the present invention relates to a method of driving this display device.

2. Description of the Related Art

Recently, along the increase in sizes of display devices, there has been a demand for thin display devices, and various kinds of thin display devices have been provided. For example, matrix panels for displaying images based on digital signals have been provided. Specifically, there have been provided gas discharge panels like PDPs, and matrix panels like DMDs (digital micromirror devices), EL (electro-luminescence) display devices, fluorescent display tubes, and liquid-crystal display devices. Among these thin display devices, the gas discharge panels can easily provide large screens because of a simple process. They, have good display quality based on a self-light-emission type, and have fast response speed. Therefore, the gas discharge panels are considered to be a most promising candidate as display devices for application to large-screens and direct-view type HDTVs (high-definition televisions).

A PDP has a plurality of light-emission blocks (sub-fields: SF) that are structured by a plurality of light-emission pulses within each field, and the PDP displays an intermediate gradation based on a combination of these light-emission blocks. Power consumed by the PDP for the light emission is proportional to the number of light-emission pulses (sustaining pulses) that contribute to the light emission. Therefore, it is possible to control the power consumption of the PDP by controlling the total number of light-emission pulses within each field. Particularly, there has been a demand for a display device that can control the number of light-emission pulses (power consumption) without degrading the image quality, and a method of driving this display device.

Conventionally, light-emission pulses are set as follows. First, a display load factor is calculated for each frame based on display data. Light-emission pulses are calculated based on the calculated display load factor for each frame, and the power consumption of the display device is controlled so as not to exceed a predetermined value. This technique is disclosed, for example, in Japanese Unexamined Patent Publication (Kokai) Nos. 06-332397 and 2000-098970.

Concretely, Japanese Unexamined Patent Publication (Kokai) No. 06-332397 discloses a flat panel display device comprising an integrating unit that integrates a number of pixel signals at a predetermined level that are given during a predetermined period, and a frequency altering unit that alters a panel driving frequency based on a result of integration by the integrating unit. Japanese Unexamined Patent Publication (Kokai) No. 2000-098970 discloses a plasma display device comprising an integrating unit that integrates-a number of pixel signals that are given during a predetermined period, in a bit signal unit for a gradation display, and a frequency altering unit that alters a sustaining discharge waveform frequency based on a result of integration by the integrating unit.

In the present specification, the term "field" is used by assuming a case in which an image of one frame is constructed of two fields of an odd-numbered field and an even-numbered field that are interlace displayed. When an image of one frame is progressively displayed, for example, the term "field" can be replaced with the term "frame".

The prior art and the problems associated with the prior art will be described in detail later with reference to accompanying drawings.

SUMMARY OF THE INVENTION

An object of the present invention is to provide a display device that can control power consumption without degrading the image quality due to flicker or the like, and a method of driving this display device.

According to the present invention, there is provided a method of driving a display device comprising the step of controlling a total number of light-emission pulses within a field, based on an average of display load factors in at least two fields.

Further, according to the present invention, there is provided a method of driving a display device comprising the steps of calculating a total number of light-emission pulses within a field, based on an average of display load factors in at least two fields; comparing the calculated number of light-emission pulses with a number of light-emission pulses based on power consumption; and applying a smaller number of light-emission pulses as the total number of light-emission pulses within the field.

The driving method may be used to display an intermediate gradation based on a combination of a plurality of light-emission blocks that emit light in predetermined light-emission pulses. The two fields may be continuous two fields. The two fields may be an odd-numbered field and an even-numbered field that interlace display an image.

According to the present invention, there is also provided a method of driving a display device comprising the step of controlling a total number of light-emission pulses within a field, based on an average of display load factors in at least three fields.

Further, according to the present invention, there is provided a method of driving a display device comprising the steps of calculating a total number of light-emission pulses within a field, based on an average of display load factors in at least three fields; comparing the calculated number of light-emission pulses with a number of light-emission pulses based on power consumption; and applying a smaller number of light-emission pulses as the total number of light-emission pulses within the field.

The driving method may further comprise the step of comparing a first average of display load factors of a first field and a second field that is one field before the first field with a second average of display load factors of the second field and a third field that is two fields before the first field. The driving method may further comprise the step of controlling a total number of light-emission pulses within a field, based on the first average of display load factors when a difference between the first and second averages exceeds a threshold value. The driving method may further comprise the step of controlling a total number of light-emission pulses within a field, based on the second average of display load factors when a difference between the first and second averages does not exceed a threshold value.

According to the present invention, there is provided a method of driving a display device comprising the step of controlling a total number of light-emission pulses within a field, based on a comparison of display load factors in at least two fields.

Further, according to the present invention, there is also provided a method of driving a display device comprising the steps of calculating a total number of light-emission pulses within a field, based on a comparison of display load factors in at least two fields; comparing the calculated number of light-emission pulses with a number of light-emission pulses based on power consumption; and applying a smaller number of light-emission pulses as the total number of light-emission pulses within the field.

The driving method may further comprise the steps of comparing a display load factor in a first field with a display load factor in a second field that is one field before the first field; and controlling a total number of light-emission pulses within a field, based on the display load factor in the first field, when a difference between the display load factors of the first and second fields exceeds a threshold value and also when the display load factor in the first field is larger than the display load factor in the second field. The driving method may further comprise the steps of comparing a display load factor in a first field with a display load factor in a second field that is one field before the first field; and controlling a total number of light-emission pulses within a field, based on the display load factor in the second field, when a difference between the display load factors of the first and second fields exceeds a threshold value and also when the display load factor in the second field is larger than the display load factor in the first field.

The driving method may further comprise the steps of comparing a display load factor in a first field with a display load factor in a second field that is one field before the first field; and controlling a total number of light-emission pulses within a field, based on the display load factor in the second field when a difference between the display load factors of the first and second fields does not exceed a threshold value. The second field may be a current field, and the first field may be a next field.

The driving method may be used to display an intermediate gradation based on a combination of a plurality of light-emission blocks that emit light in predetermined light-emission pulses. The driving method may further comprise the steps of comparing a display load factor in a first field with a display load factor in a third field that is two field before the first field; and controlling a total number of light-emission pulses within a field, based on the display load factor in the first field, when a difference between the display load factors of the first and third fields exceeds a threshold value.

The driving method may further comprise the steps of comparing a display load factor in a first field with a display load factor in a third field that is two field before the first field; comparing the display load factor in the first field with a display load factor in a second field that is one field before the first field when a difference between the display load factors of the first and third fields does not exceed a threshold value; and controlling a total number of light-emission pulses within a field, based on the display load factor in the second field when a difference between the display load factors of the first and second fields does not exceed a threshold value.

The driving method may further comprise the steps of comparing a display load factor in a first field with a display load factor in a third field that is two field before the first field; comparing the display load factor in the first field with a display load factor in a second field that is one field before the first field when a difference between the display load factors of the first and third fields does not exceed a threshold value; and controlling a total number of light-emission pulses within a field, based on the display load factor in the first field, when a difference between the display load factors of the first and second fields exceeds a threshold value and also when the display load factor in the first field is larger than the display load factor in the second field. The driving method may further comprise the steps of comparing a display load factor in a first field with a display load factor in a third field that is two field before the first field; comparing the display load factor in the first field with a display load factor in a second field that is one field before the first field when a difference between the display load factors of the first and third fields does not exceed a threshold value; and controlling a total number of light-emission pulses within a field, based on the display load factor in the second field, when a difference between the display load factors of the first and second fields exceeds a threshold value and also when the display load factor in the second field is larger than the display load factor in the first field. The second field may be a current field, the first field may be a next field, and the third field may be a preceding field.

According to the present invention, there is provided a display device comprising a display panel; a data converter that receives an image signal, supplies image data suitable for the display device to the display panel, calculates display load factors based on the image signal, and outputs the display load factors; a power source that supplies power to the display panel, and outputs power information of power to be consumed in the display panel; and a power control circuit that receives the display load factors and the power consumption information, wherein the power control circuit comprises a calculating unit calculating a total number of light-emission pulses within a field, based on an average of display load factors in at least two fields; a comparing unit comparing the calculated number of light-emission pulses with a number of light-emission pulses based on power consumption; and a controlling unit applying a smaller number of light-emission pulses as the total number of light-emission pulses within a field.

The display device may display an intermediate gradation based on a combination of a plurality of light-emission blocks that emit light in predetermined light-emission pulses. The two fields may be continuous two fields. The two fields may be an odd-numbered field and an even-numbered field that interlace display an image.

Further, according to the present invention, there is also provided a display device comprising a display panel; a data converter that receives an image signal, supplies image data suitable for the display device to the display panel, calculates display load factors based on the image signal, and outputs the display load factors; a power source that supplies power to the display panel, and outputs power information of power to be consumed in the display panel; and a power control circuit that receives the display load factors and the power consumption information, wherein the power control circuit comprises a calculating unit calculating a total number of light-emission pulses within a field, based on an average of display load factors in at least three fields; a comparing unit comparing the calculated number of light-emission pulses with a number of light-emission pulses based on power consumption; and a controlling unit applying a smaller number of light-emission pulses as the total number of light-emission pulses within a field.

The power control circuit may further comprise an additional comparing unit comparing a first average of display load factors of a first field and a second field that is one field before the first field with a second average of display load factors of the second field and a third field that is two fields before the first field. The power control circuit may further comprise an additional controlling unit controlling a total number of light-emission pulses within a field, based on the average of display load factors of the first field and the second field when a difference between the first and second averages exceeds a threshold value, in the comparison result. The power control circuit may further comprise an additional controlling unit controlling a total number of light-emission pulses within a field, based on the average of display load factors of the second field and the third field when a difference between the first and second averages does not exceed a threshold value, in the comparison result.

According to the present invention, there is provided a display device comprising a display panel; a data converter that receives an image signal, supplies image data suitable for the display device to the display panel, calculates display load factors based on the image signal, and outputs the display load factors; a power source that supplies power to the display panel, and outputs power information of power to be consumed in the display panel; and a power control circuit that receives the display load factors and the power consumption information, wherein the power control circuit comprises a calculating unit calculating a total number of light-emission pulses within a field, based on a comparison of display load factors in at least two fields; a comparing unit comparing the calculated number of light-emission pulses with a number of light-emission pulses based on power consumption; and a controlling unit applying a smaller number of light-emission pulses as the total number of light-emission pulses within a field.

The power control circuit may further comprise an additional comparing unit comparing a display load factor in a first field with a display load factor in a second field that is one field before the first field; and an additional controlling unit controlling a total number of light-emission pulses within a field, based on the display load factor in the first field, when a difference between the display load factors of the first and second fields exceeds a threshold value and also when the display load factor in the first field is larger than the display load factor in the second field. The power control circuit may further comprise an additional comparing unit comparing a display load factor in a first field with a display load factor in a second field that is one field before the first field; and an additional controlling unit controlling a total number of light-emission pulses within a field, based on the display load factor in the second field, when a difference between the display load factors of the first and second fields exceeds a threshold value and also when the display load factor in the second field is larger than the display load factor in the first field.

The power control circuit may further comprise an additional comparing unit comparing a display load factor in a first field with a display load factor in a second field that is one field before the first field; and an additional controlling unit controlling a total number of light-emission pulses within a field, based on the display load factor in the second field when a difference between the display load factors of the first and second fields does not exceed a threshold value. The second field may be a current field, and the first field may be a next field. The display device may display an intermediate gradation based on a combination of a plurality of light-emission blocks that emit light in predetermined light-emission pulses.

The power control circuit may further comprise an additional comparing unit comparing a display load factor in a first field with a display load factor in a third field that is two field before the first field; and an additional controlling unit controlling a total number of light-emission pulses within a field, based on the display load factor in the first field, when a difference between the display load factors of the first and third fields exceeds a threshold value. The power control circuit may further comprise a first additional comparing unit comparing a display load factor in a first field with a display load factor in a third field that is two field before said first field; a second additional comparing unit comparing the display load factor in said first field with a display load factor in a second field that is one field before said first field when a difference between the display load factors of said first and third fields does not exceed a threshold value; and an additional controlling unit controlling a total number of light-emission pulses within a field, based on the display load factor in said second field when a difference between the display load factors of said first and second fields does not exceed a threshold value.

The power control circuit may further comprise a first additional comparing unit comparing a display load factor in a first field with a display load factor in a third field that is two field before the first field; a second additional comparing unit comparing the display load factor in the first field with a display load factor in a second field that is one field before the first field when a difference between the display load factors of the first and third fields does not exceed a threshold value; and an additional controlling unit controlling a total number of light-emission pulses within a field, based on the display load factor in the first field, when a difference between the display load factors of the first and second fields exceeds a threshold value and also when the display load factor in the first field is larger than the display load factor in the second field. The power control circuit may further comprise a first additional comparing unit comparing a display load factor in a first field with a display load factor-in a third field that is two field before the first field; a second additional comparing unit comparing the display load factor in the first field with a display load factor in a second field that is one field before the first field when a difference between the display load factors of the first and third fields does not exceed a threshold value; and an additional controlling unit controlling a total number of light-emission pulses within a field, based on the display load factor in the second field, when a difference between the display load factors of the first and second fields exceeds a threshold value and also when the display load factor in the second field is larger than the display load factor in the first field. The second field may be a current field, the first field may be a next field, and the third field may be a preceding field.

BRIEF DESCRIPTION OF THE DRAWINGS

The present invention will be more clearly understood from the description of the preferred embodiments as set forth below with reference to the accompanying drawings, wherein:

FIG. 5B is applied;

FIG. 5B is applied;

FIG. 7 is a flowchart showing another example of a method of driving a display device relating to the present invention;

DETAILED DESCRIPTION OF THE PREFERRED EMBODIMENTS

Before describing in detail the embodiments of the present invention, problems of conventional display devices and driving methods will be explained with reference to drawings.

Figure 1:
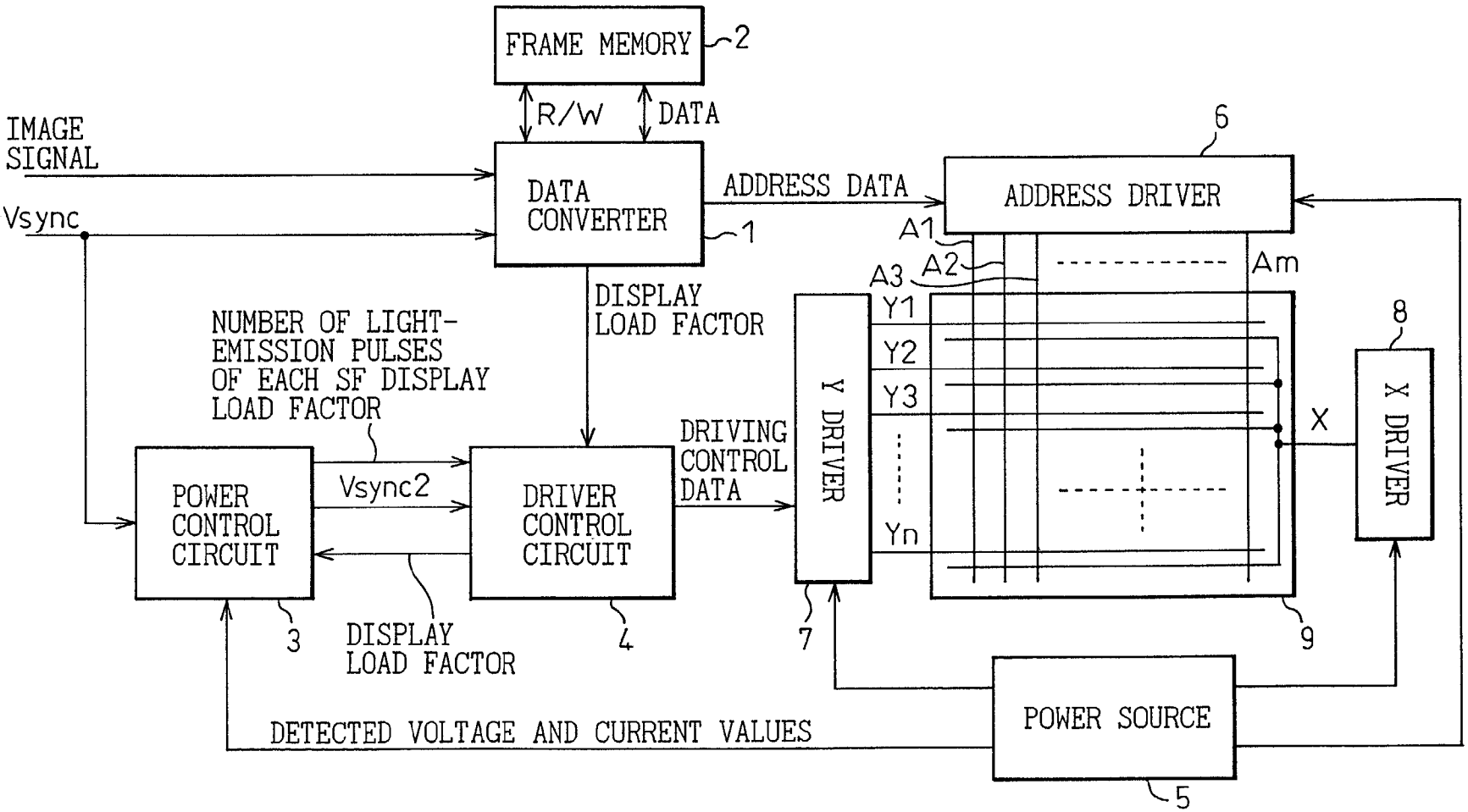
FIG. 1 is a block diagram showing one example of a display device to which the present invention is applied.

FIG. 1 is a block diagram showing one example of a display device according to the present invention. This shows one example of a plasma display device (a plasma display panel: PDP). In FIG. 1, a reference number 1 denotes a data converter, 2 denotes a frame memory, and 3 denotes a power control circuit. A reference number 4 denotes a driver control circuit, 5 denotes a power source, 6 denotes an address driver, 7 denotes a Y driver, 8 denotes an X driver, and 9 denotes a display panel.

As shown in FIG. 1, the data converter 1 receives an image signal and a vertical synchronization signal Vsync from the outside, and converts the data into data for the PDP (data for displaying an image based on a plurality of light-emission blocks (sub-fields SF)). The frame memory 2 holds the PDP data for the next field that has been obtained based on the data conversion by the data converter 1. The data converter 1 supplies data that has been held in the frame memory 2 to the address driver 6 as address data, and gives a display load factor to the driver control circuit 4. The display load factor is a load factor that is obtained by counting the number of lighting cells (light-emitting dots) in each light-emission block.

The driver control circuit 4 receives a control signal of a number of light-emission pulses (a number of sustaining pulses) of each light-emission block (SF) and an internally generated vertical synchronization signal Vsync2 from the power control circuit 3, and supplies driving control data to the Y driver 7. The data signal of the display load factor from the data converter 1 is supplied to the power control circuit 3 via the driver control circuit 4.

The display panel 9 is provided with address electrodes A1 to Am, Y electrodes Y1 to Yn, and an X electrode X, which are driven by an address driver 6, a Y driver 7, and an X driver 8, respectively. The power source 5 supplies power to the address driver 6, the Y driver 7, and the X driver 8, respectively. Further, the power source 5 detects a voltage and a current supplied to the address driver 6, the Y driver 7, and the X driver 8, respectively, and supplies the detected voltages and currents to the power control circuit 3. In other words, the detected address voltage and current of the address driver 6, and the detected sustaining voltages and currents of the Y driver 7 and the X driver 8, are supplied from the power source 5 to the power control circuit 3. These supplied voltages and currents are used for the processing in the power control circuit 3. A display panel section is constructed of the address driver 6, the Y driver 7, the X driver 8, and the display panel 9.

Figure 2:
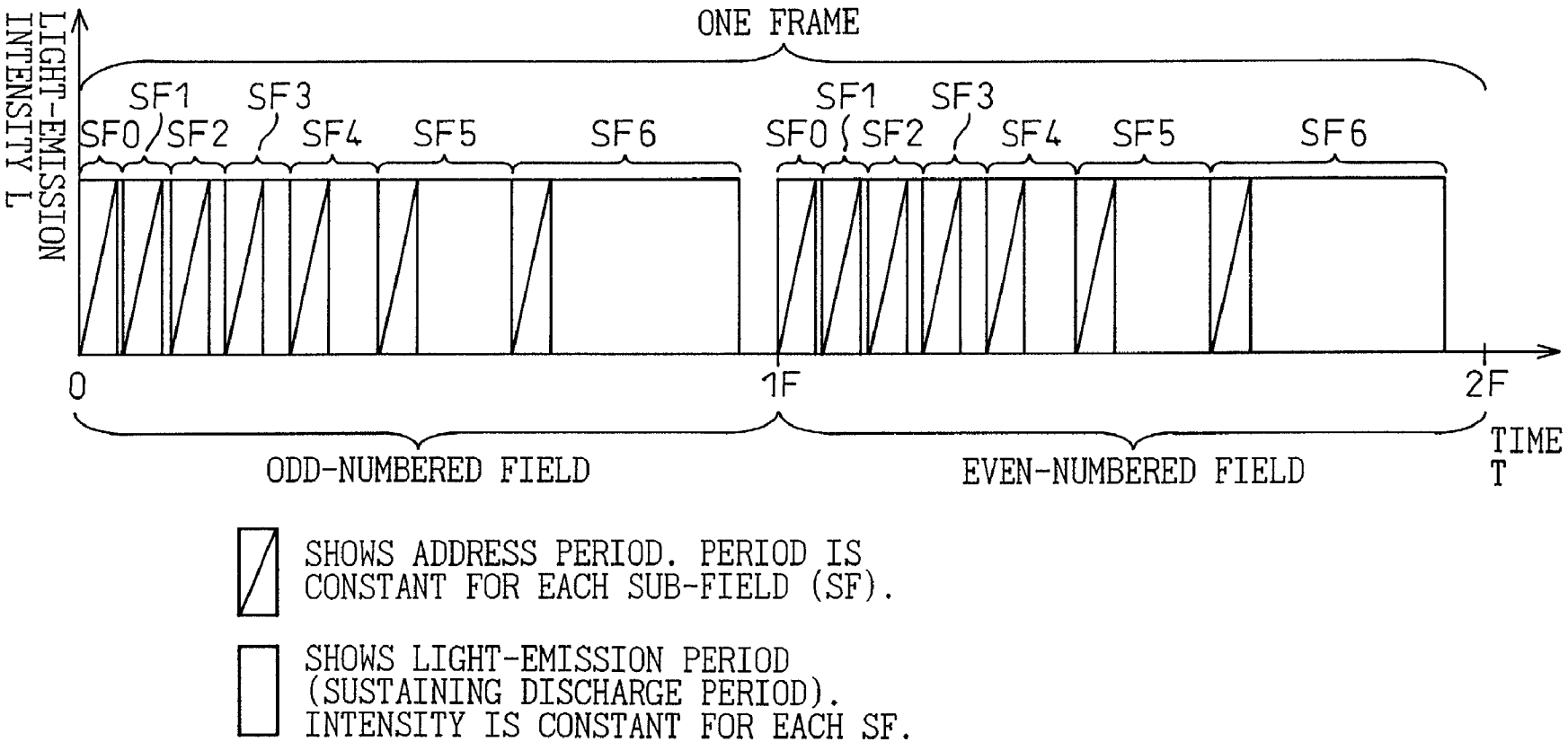
FIG. 2 is a diagram for explaining one example of a method of driving the display device shown in FIG. 1.

FIG. 2 is a diagram for explaining one example of a method of driving the display device shown in FIG. 1.

The driving method shown in FIG. 2 is for interlace displaying an image of one frame having two fields of an odd-numbered field and an even-numbered field. Each of the odd-numbered field and the even-numbered field consists of a plurality of light-emission blocks (sub-fields, for example, seven sub-fields from SF0 to SF6). The light-emission blocks SF0 to SF6 include address periods for performing address discharging of a lighting cell according to address data, and a light-emission period (a sustaining discharge period) for-applying light-emission pulses (sustaining pulses) to a selected cell (lighting cell) to make the cell emit light.

Figure 3:
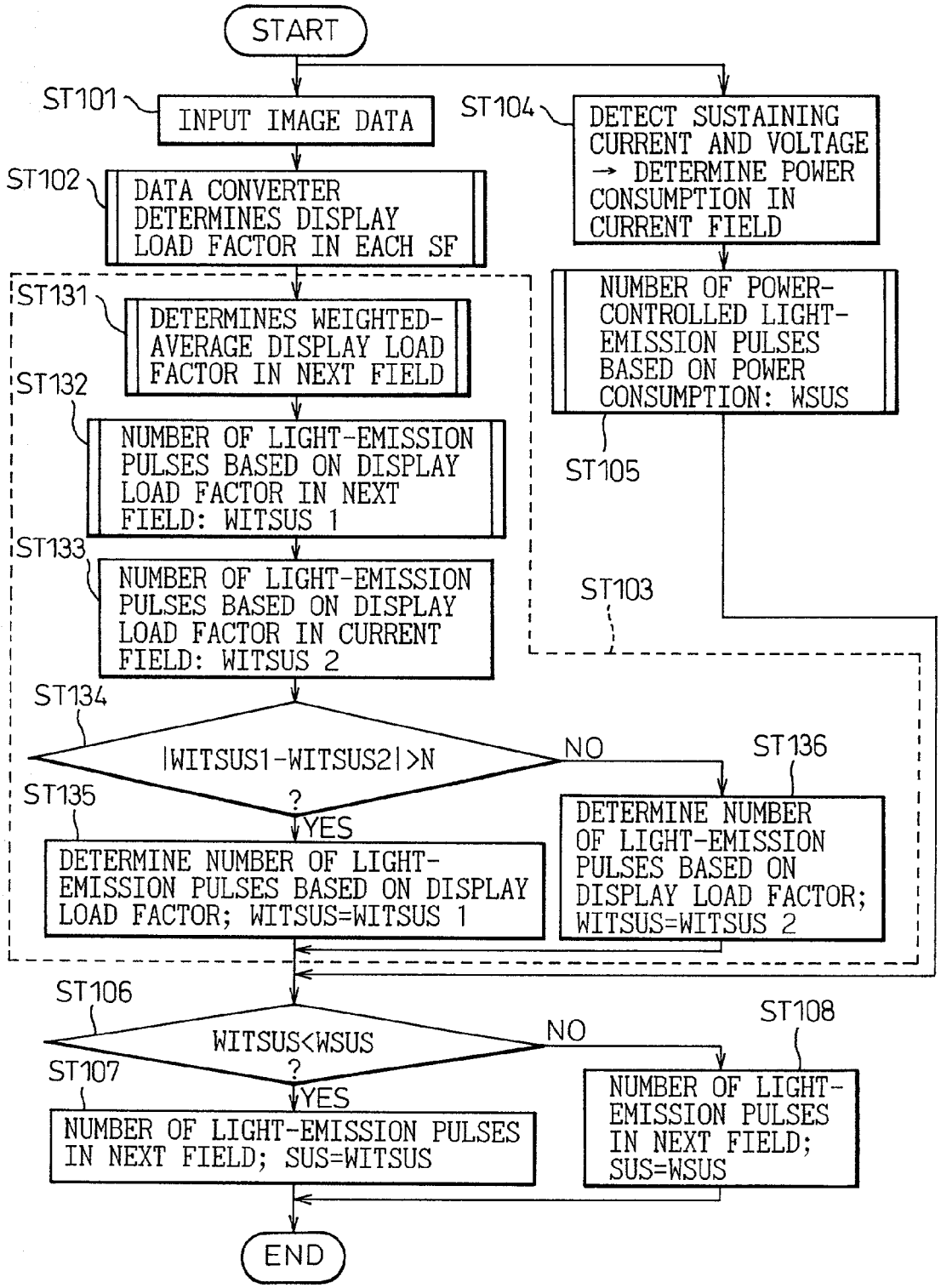
FIG. 3 is a flowchart showing one example of a conventional method of driving a display device.

FIG. 3 is a flowchart showing one example of a conventional method of driving a display device. This mainly explains a power consumption limit processing that is carried out by the power control circuit 3 shown in FIG. 1.

As shown in FIG. 3, when the power limit processing is started, image data is input at step ST 101. The data converter 1 determines a display load factor of each light-emission block (sub-field SF) at step ST 102, and determines the number of light-emission pulses based on the display load factor at step ST 103.

In parallel with the processing at steps ST 101 to ST 103, power consumption in the next field is determined at step ST 104 based on the sustaining current and voltage that have been detected by the power source 5. At step ST 105, a number of power-controlled light-emission pulses WSUS is calculated based on the power consumption determined at step ST 104. As a result, the number of power-controlled light-emission pulses WSUS based on the power consumption is obtained.

At step ST 103, the number of light-emission pulses is obtained based on the display load factor, in the following process. First, a weighted average of load factors in the next field is determined at step ST 131. At step ST 132, a number of light-emission pulses WITSUS 1 is calculated based on the weighted-average load factor in the next field. The weighted-average load factor is an average load factor that takes into account the weight of light emission (brightness) in the light-emission blocks (sub-fields, for example, SF0 to SF6).

At step ST 133, a number of light-emission pulses WITSUS 2 is calculated based on a weighted-average load factor in the current field, and the process proceeds to step ST 134. At step ST 134, it is decided whether or not an absolute value of a difference between the number of light-emission pulses WITSUS 1 based on the weighted-average load factor in the next field and the number of light-emission pulses WITSUS 2 based on the weighted-average load factor in the current field that have been calculated at steps ST 132 and ST 105 is larger than a predetermined value N (|WITSUS 1−WITSUS 2|>N?). The current field is one field before the next field.

When it has been decided at step ST 134 that the relationship of |WITSUS 1−WITSUS 2|>N is satisfied, the process proceeds to step-ST 135. At step ST 135, the number of light-emission pulses WITSUS 1 based on the weighted-average load factor in the next field is prescribed as the number of light-emission pulses WITSUS based on the load factor (WITSUS=WITSUS 1). On the other hand, when it has been decided at step ST 134 that the relationship of |WITSUS 1−WITSUS 2|>N is not satisfied, the process proceeds to step ST 136. At step ST 136, the number of light-emission pulses WITSUS 2 based on the weighted-average load factor in the current field is prescribed as the number of light-emission pulses WITSUS based on the load factor (WITSUS=WITSUS 2). In other words, when the difference between the WITSUS 1 in the next field and the WITSUS 2 in the current field is smaller than the predetermined value N, the WITSUS 2 in the current field is maintained as the number of light-emission pulses WITSUS based on the load factor.

As explained above, the number of light-emission pulses WITSUS based on the load factor is decided at step ST 103. Next, the number of light-emission pulses WITSUS based on the load factor is compared with the number of power-controlled light-emission pulses WSUS based on the power consumption, at step ST 106. In other words, at step ST 106, it is decided whether or not the number of light-emission pulses WITSUS based on the load factor is smaller than the number of power-controlled light-emission pulses WSUS based on the power consumption obtained at step ST 105 (WITSUS<SUS?).

When it has been decided at step ST 106 that WITSUS<SUS is satisfied, the process proceeds to step ST 107. At step ST 107, the number of light-emission pulses SUS in the next field is prescribed as the number of light-emission pulses WITSUS based on the load factor (SUS=WITSUS). On the other hand, when it has been decided at step ST 106 that WITSUS<SUS is not satisfied, the process proceeds to step ST 108. At step ST 108, the number of light-emission pulses SUS in the next field is prescribed as the number of power-controlled light-emission pulses WSUS based on the power consumption (SUS=WSUS). Then, the processing is finished. In other words, a number of light-emission pulses that is smaller between the number of light-emission pulses WITSUS based on the load factor and the number of power-controlled light-emission pulses WSUS based on the power consumption is determined as the number of light-emission pulses SUS in the next field.

In the case of interlace displaying an image of one frame having two fields of an odd-numbered field and an even-numbered field, the odd-numbered field and the even-numbered field are displayed by skipping one line respectively. Therefore, flicker could occur easily when there is a difference between the load factors.

In the actual television images, load factors are not substantially different between the odd-numbered field and the even-numbered field. However, in the case of displaying a digital image that is different from the image format of a display device, data is prepared based on a conversion like interpolation. Therefore, depending on the conversion method, there is a large difference between the load factor of the odd-numbered field and the load factor of the even-numbered field. For example, in the case of displaying an image of XGA (1024×768) on a PDP for displaying a television image, the data is converted based on a predetermined interpolation method. At this time, a large difference could occur between the load factor of the odd-numbered field and the load factor of the even-numbered field.

Figures 4A, 4B:
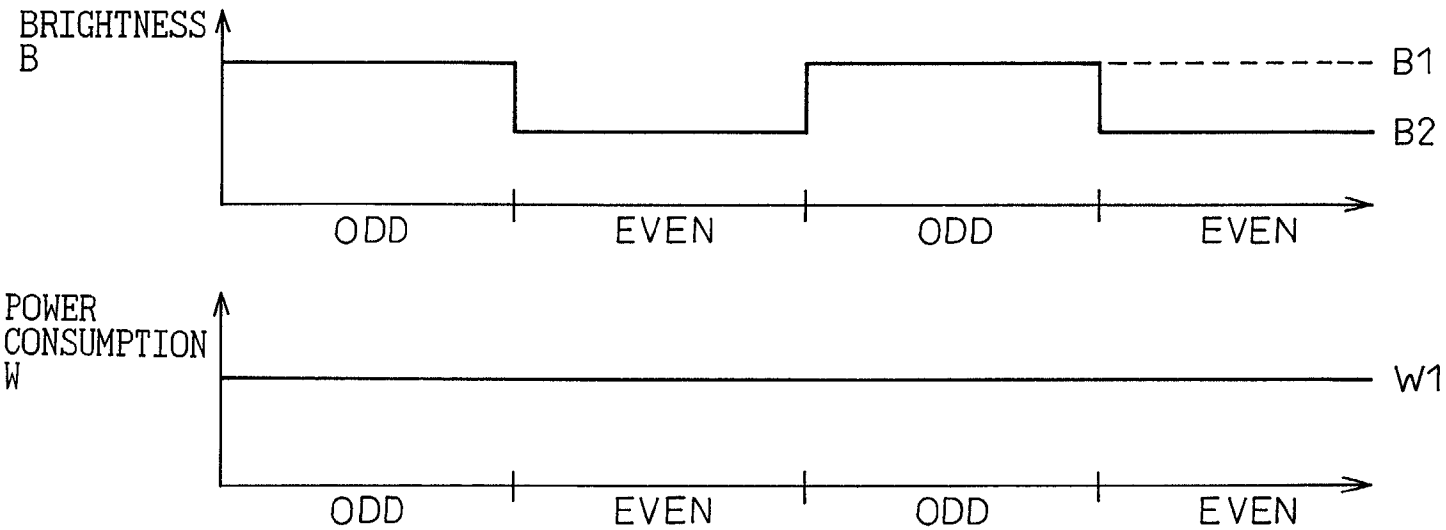
FIG. 4A is a diagram showing brightness characteristics of a display device to which the driving method shown in FIG. 3 is applied.
FIG. 4B is a diagram showing power characteristics of a display device to which the driving method shown in FIG. 3 is applied.

FIG. 4A is a diagram showing brightness characteristics of a display device to which the driving method shown in FIG. 3 is applied, and FIG. 4B is a diagram showing power characteristics of a display device to which the driving method shown in FIG. 3 is applied. In other words, FIG. 4A and FIG. 4B show brightness characteristics and consumption power characteristics when the load factor of the odd-numbered field (ODD) and the load factor of the even-numbered field (EVEN) are greatly different from each other.

According to the conventional method of driving a display device explained with reference to FIG. 3, it is possible to hold power consumption W at a constant value W1 as shown in FIG. 4B. However, brightness B becomes different between brightness B1 in the odd-numbered field and brightness B2 in the even-numbered field, as shown in FIG. 4A. In other words, according to the conventional driving method shown in FIG. 3, the number of light-emission pulses changes in order to hold the power W at the constant value W1. Therefore, there occurs a large difference between the load factor in the odd-numbered field and the load factor in the even-numbered field. As a result, there occurs a difference between the brightness B1 in the odd-numbered field and the brightness B2 in the even-numbered field. This difference is visually recognized as flicker.

According to the conventional driving method, a hysteresis (a predetermined value N in the processing at step ST 134) is set so as not to generate flicker when there is subtle variation in the load factor between the fields. Therefore, when the load factor varies within a small range, it is possible to prevent the occurrence of flicker. However, flicker occurs when the load factor varies greatly between the fields and also when this variation is repeated.

Embodiments of a display device and a method of driving this display device according to the present invention will be explained in detail with reference to the drawings. It should be noted that the application of the method of driving the display device relating to the present invention is not limited to PDP's. It is also possible to widely apply this driving method to display devices that express gradations by using an intra-frame time-division method, that is, various display devices that perform gradation display by dividing one frame period into a plurality of sub-frames having a plurality of various light-emission periods.

As explained above, in the present specification, the term "field" is used by assuming a case in which an image of one frame is constructed of two fields of an odd-numbered field and an even-numbered field that are interlace displayed. When an image of one frame is progressively displayed, for example, the term "field" can be replaced with the term "frame".

Figure 5A:
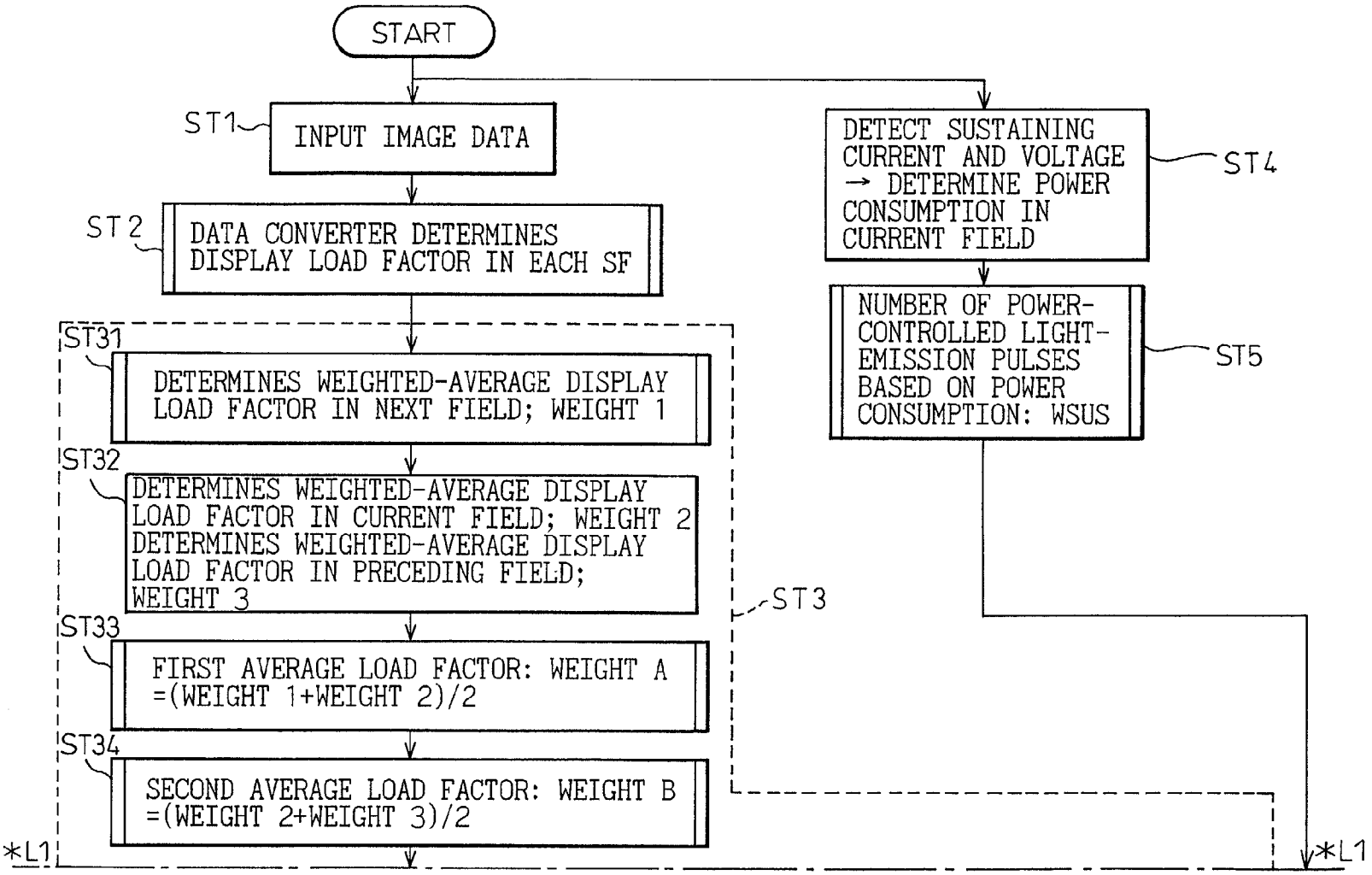
FIG. 5A and FIG. 5B are flowcharts showing one example of a method of driving a display device relating to the present invention.
Figure 5B:
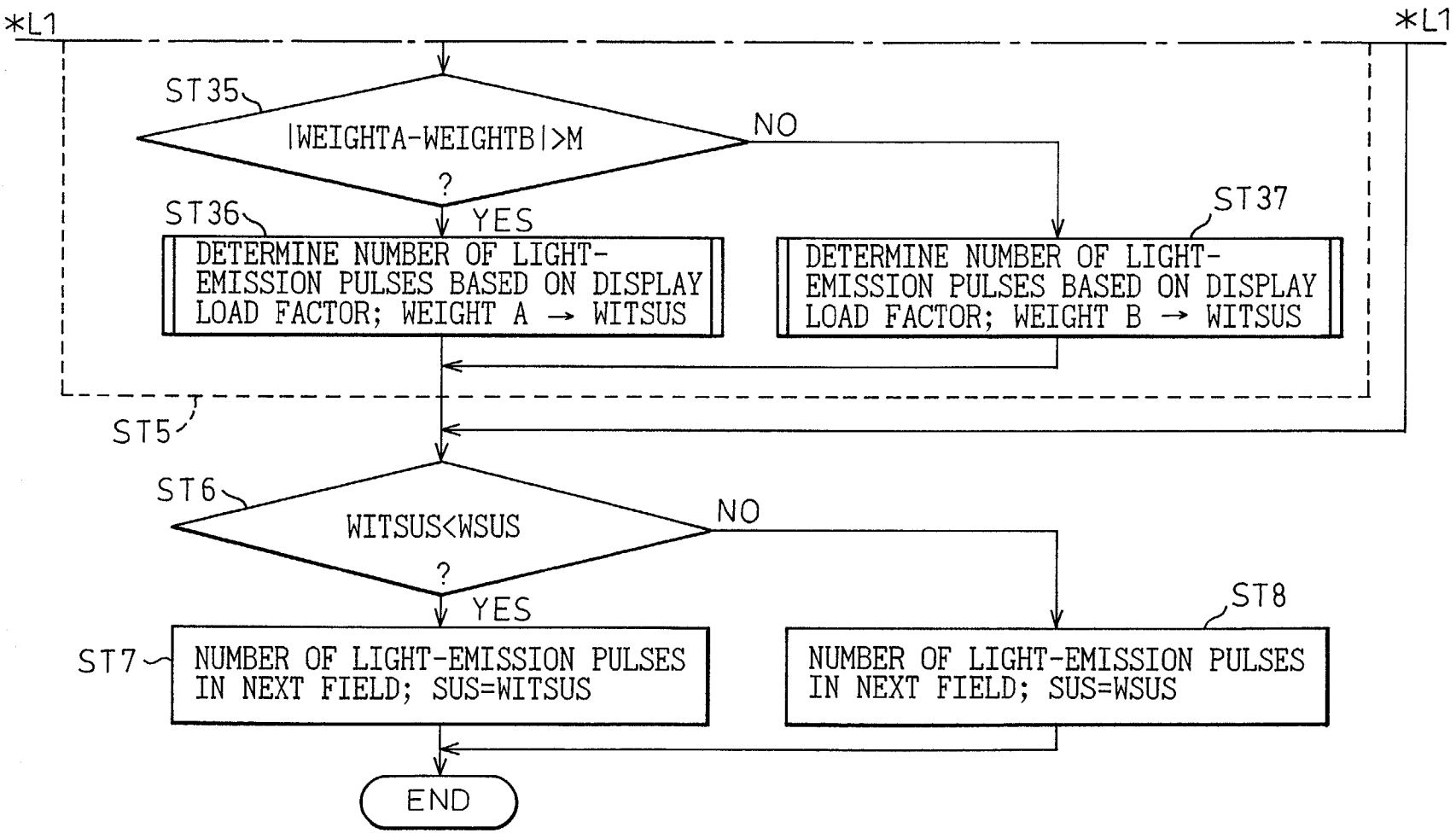

FIG. 5A and FIG. 5B are flowcharts showing one example of a method of driving a display device relating to the present invention. These flowcharts mainly explain the power consumption limit processing that is carried out by the power control circuit 3 explained above with reference to FIG. 1. A display device to which the embodiment of the present invention is applied is basically similar to that having the same structure explained above with reference to FIG. 1 and FIG. 2, and their explanation will be omitted here.

As shown in FIG. 5A, when the power limit processing is started, image data is input at step ST 1. The data converter 1 determines a display load factor of each light-emission block (SF) at step ST 2, and determines the number of light-emission pulses based on the display load factor at step ST 3.

In parallel with the processing at steps ST 1 to ST 3, power consumption in the next field is determined at step ST 4 based on the sustaining current and voltage that have been detected by the power source 5. At step ST 5, a number of power-controlled light-emission pulses WSUS is calculated based on the power consumption determined at step ST 4. As a result, the number of power-controlled light-emission pulses WSUS based on the power consumption is obtained.

At step ST 3, the number of light-emission pulses is obtained based on the display load factor, in the following process. First, a weighted average of load factors in the next field WEIGHT 1 is determined at step ST 31. At step ST 32, a weighted-average load factor WEIGHT 2 in the current field that is one field before the next field, and a weighted-average load factor WEIGHT 3 in the field that is two fields before the next field are determined, and the process proceeds to step ST 33. At step ST 33, a first average load factor WEIGHT A that is an average of the weighted-average load factor WEIGHT 1 in the next field and the weighted-average load factor WEIGHT 2 in the current field (that is, WEIGHT A=(WEIGHT 1+WEIGHT 2)/2) is calculated. Then, the process proceeds to step ST 34.

At step ST 34, a second average load factor WEIGHT B that is an average of the weighted-average load factor WEIGHT 2 in the current field and the weighted-average load factor WEIGHT 3 in the preceding field (that is, WEIGHT B=(WEIGHT 2+WEIGHT 3)/2) is calculated. The process proceeds to step ST 35. At step ST 35, it is decided whether or not an absolute value of a difference between the first average load factor WEIGHT A and the second average load factor WEIGHT B that have been calculated at steps ST 33 and ST 34 is larger than a predetermined value M (|WEIGHT A−WEIGHT B|>M?).

When it has been decided at step ST 35 that the relationship of |WEIGHT A−WEIGHT B|>M is satisfied, the process proceeds to step ST 36. At step ST 36, the first average load factor WEIGHT A is prescribed as the number of light-emission pulses WITSUS based on the load factor (WITSUS=WEIGHT A). On the other hand, when it has been decided at step ST 35 that the relationship of |WEIGHT A−WEIGHT B|>M is not satisfied, the process proceeds to step ST 37. At step ST 37, the second average load factor WEIGHT B is prescribed as the number of light-emission pulses WITSUS based on the load factor (WITSUS=WEIGHT B). In other words, when the difference between the first average load factor WEIGHT A and the second average load factor WEIGHT B is smaller than the predetermined value M, the second average load factor WEIGHT B is used as the number of light-emission pulses WITSUS based on the load factor.

As explained above, the number of light-emission pulses WITSUS based on the load factor is decided at step ST 3 for deciding the number of light-emission pulses based on the load factor. Next, it is decided at step ST 6 whether or not the number of light-emission pulses WITSUS based on the load factor is smaller than the number of power-controlled light-emission pulses WSUS based on the power consumption obtained at step ST 5 (WITSUS<SUS?).

When it has been decided at step ST 6 that WITSUS<WSUS is satisfied, the process proceeds to step ST 7. At step ST 7, the number of light-emission pulses SUS in the next field is prescribed as the number of light-emission pulses WITSUS based on the load factor (SUS=WITSUS). On the other hand, when it has been decided at step ST 6 that WITSUS<WSUS is not satisfied, the process proceeds to step ST 8. At step ST 8, the number of light-emission pulses SUS in the next field is prescribed as the number of power-controlled light-emission pulses WSUS based on the power consumption (SUS=WSUS). Then, the processing is finished. In other words, a number of light-emission pulses that is smaller between the number of light-emission pulses WITSUS based on the load factor and the number of power-controlled light-emission pulses WSUS based on the power consumption is determined as the number of light-emission pulses SUS in the next field.

As explained above, according to the embodiment shown in FIG. 5A and FIG. 5B, when there is a large difference between the display load factor in the odd-numbered field and the display load factor in the even-numbered field in the interlace driving, the two fields are considered as one frame. Power is controlled based on this frame unit.

When power is controlled in the frame unit, the number of light-emission pulses does not change between the odd-numbered field and the even-numbered field, even if the load factor in the odd-numbered field and the load factor in the even-numbered field are different from each other and when this is repeated. As a result, it is possible to suppress the occurrence of flicker, and it is also possible to maintain brightness at a constant level.

Figures 6A, 6B:
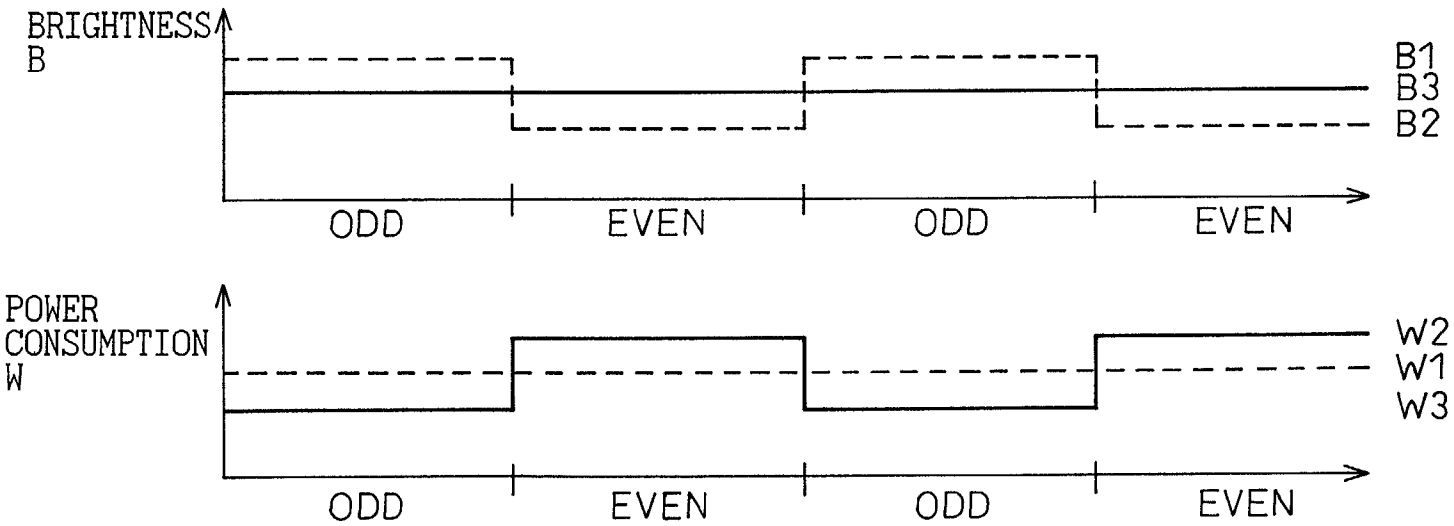
FIG. 6A is a diagram showing brightness characteristics of a display device to which the driving method shown in FIG. 5A
FIG. 6B is a diagram showing power characteristics of a display device to which the driving method shown in FIG. 5A

FIG. 6A is a diagram showing brightness characteristics of a display device to which the driving method shown in FIG. 5A and FIG. 5B is applied. FIG. 6B is a diagram showing power characteristics of a display device to which the driving method shown in FIG. 5A and FIG. 5B is applied.

According to the driving method explained with reference to FIG. 5A and FIG. 5B, the number of light-emission pulses is determined based on the average of the display load factors. Therefore, as shown in FIG. 6A and FIG. 6B, it is possible to set the brightness (B3) as an intermediate value (an average value) of the brightness B1 and B2 shown in FIG. 4A. As a result, it is possible to prevent the degradation in the image quality by preventing the occurrence of flicker. However, in the present embodiment, the power consumption changes to W3 and W2 corresponding to the odd-numbered field and the even-numbered field, around the constant power consumption W3 shown in FIG. 4B.

In other words, in the field (the even-numbered field) in which the display load factor is larger than the average value of the display load factors in the two fields, the number of light-emission pulses becomes larger than the prescribed number, and the brightness becomes higher than the design value. Consequently, the power consumption becomes larger than the design value. On the other hand, in the field (the odd-numbered field) in which the display load factor is smaller than the average value of the display load factors in the two fields, the number of light-emission pulses becomes smaller than the prescribed number, and the brightness becomes lower than the design value. Consequently, the power consumption becomes smaller than the design value.

FIG. 7 is a flowchart showing another example of a method of driving a display device relating to the present invention.

As is clear from the comparison between FIG. 7 and FIGS. 5A and 5B, steps ST 1, ST 2, and ST 4 to ST 8 in FIG. 7 show similar contents of processing to those explained at the same steps of the driving method in FIG. 5A and FIG. 5B. Therefore, their explanation will be omitted here. In other words, the driving method of the embodiment shown in FIG. 7 has step ST 9 in place of step ST 3 of the driving method in FIGS. 5A and 5B.

In the present embodiment, the power limit processing is carried out as follows. As shown in FIG. 7, the data converter 1 determines a display load factor of each light-emission block (SF) at step ST 2. Then, a number of light-emission pulses based on the display load factor is determined at step ST 9. First, at step ST 91, a weighted average of load factors in the next field WEIGHT 1 and a weighted average of load factors in a current field that is one field before the next filed WEIGHT 2 are determined, and at the same time, a weighted average of load factors in a preceding field that is two fields before the next field WEIGHT 3 is determined. The process proceeds to step ST 92.

At step ST 92, it is decided whether or not an absolute value of a difference between the weighted-average load factor WEIGHT 1 in the next field and the weighted-average load factor WEIGHT 3 in the preceding field that have been calculated at step ST 91 is larger than a predetermined value L (|WEIGHT 1−WEIGHT 3|>L?).

When it has been decided at step ST 92 that the relationship of |WEIGHT 1−WEIGHT 3|>L is satisfied, the process proceeds to step ST 93. At step ST 93, the weighted-average load factor WEIGHT 1 in the next field is prescribed as the number of light-emission pulses WITSUS based on the load factor (WITSUS=WEIGHT 1). On the other hand, when it has been decided at step ST 92 that the relationship of |WEIGHT 1−WEIGHT 3|>L is not satisfied, the process proceeds to step ST 94. At step ST 94, it is decided whether or not an absolute value of a difference between the weighted-average load factor WEIGHT 1 in the next field and the weighted-average load factor WEIGHT 2 in the current field that is one field before the next field is larger than a predetermined value M (|WEIGHT 1−WEIGHT 2|>M?).

When it has been decided at step ST 94 that the relationship of |WEIGHT 1−WEIGHT 2|>M is satisfied, the process proceeds to step ST 96. At step ST 96, it is decided whether or not the weighted-average load factor WEIGHT 1 in the next field is larger than the weighted-average load factor WEIGHT 2 in the current field (WEIGHT 1>WEIGHT 2?).

When it has been decided at step ST 96 that the relationship of WEIGHT 1>WEIGHT 2 is satisfied, the process proceeds to step ST 93, like when it has been decided at step ST 92 that the relationship of |WEIGHT 1−WEIGHT 3|>L is satisfied. At step ST 93, the weighted-average load factor WEIGHT 1 in the next field is prescribed as the number of light-emission pulses WITSUS based on the load factor (WITSUS=WEIGHT 1).

On the other hand, when it has been decided at step ST 96 that the relationship of WEIGHT 1>WEIGHT 2 is not satisfied, the process proceeds to step ST 95. Further, when it has been decided at step ST 94 that the relationship of |WEIGHT 1−WEIGHT 2|>M is not satisfied, the process also proceeds to step ST 95. At step ST 95, the weighted-average load factor WEIGHT 2 in the current field is prescribed as the number of light-emission pulses WITSUS based on the load factor (WITSUS=WEIGHT 2).

As explained above, according to the embodiment shown in FIG. 7, when a field of a large display load factor (the odd-numbered field) and a field of a small display load factor (the even-numbered field) are repeated, the number of light-emission pulses is set always based on the field of the large display load factor. Therefore, the number of light-emission pulses with small power consumption is set. As a result, it is possible to suppress flicker without making the power consumption larger than the set value.

Figure 8A:
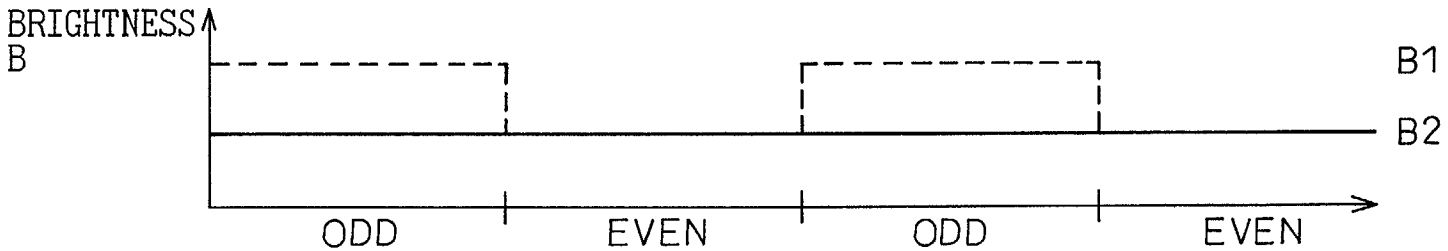
FIG. 8A is a diagram showing brightness characteristics of a display device to which the driving method shown in FIG. 7 is applied.
Figure 8B:
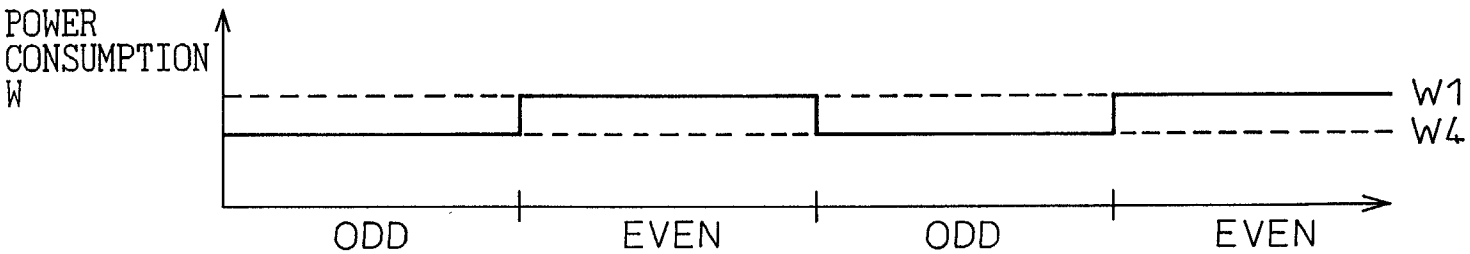
FIG. 8B is a diagram showing power characteristics of a display device to which the driving method shown in FIG. 7 is applied.

In other words, based on the comparison of the next field with only the current field, control is delayed by one field, when an image of a large display load factor changes to an image of a small display load factor. The control becomes severe by one Vsync. Consequently, an image of 10w brightness is displayed. To overcome this difficulty, according to the driving method explained with reference to FIG. 7, the following two cases are distinguished from each other. A case in which a load factor in the odd-numbered field and a load factor in the even-numbered field are greatly different from each other and this pattern is repeated, is distinguished from a case in which a display load factor changes greatly and an image has changed. As shown in FIG. 8A and FIG. 8B, a display load factor in the next field is compared with a display load factor in the preceding field. In other words, display load factors in odd-numbered fields are compared with each other, or display-load factors in even-numbered fields are compared with each other. When there is a change in the display load factor in excess of a constant value, priority is placed on the display load factor in the next field, and a number of light-emission pulses is determined based on this display load factor.

FIG. 8A and FIG. 8B are diagrams showing brightness characteristics and power characteristics respectively of a display device to which the driving method shown in FIG. 7 is applied.

According to the driving method explained with reference to FIG. 7, brightness (B2) is held at the lower brightness B2 in FIG. 4A, a shown in FIG. 8A. Further, according to the driving method explained with reference to FIG. 7, a maximum value of power consumption W is controlled so as not to exceed the constant power consumption W1 in FIG. 4B, a shown in FIG. 8B. In other words, the power consumption in the odd-numbered field becomes W4 that is smaller than the constant power consumption W1 in FIG. 4B. Further, the power consumption in the even-numbered field becomes the power consumption W1.

As explained above, according to the-embodiment shown in FIG. 7, when the display load factors are different between fields at the time of interlace driving, it is possible to suppress the occurrence of flicker due to this difference. Further, when an image changes to a next image and a display load factor changes greatly at this time, it is also possible to suppress the occurrence of flicker without lowering the brightness.

As explained above in detail, according to the present invention, it is possible to provide a display device capable of controlling power consumption without generating degradation in image quality like flicker, and a method of driving this display device.

Many different embodiments of the present invention may be constructed without departing from the spirit and scope of the present invention, and it should be understood that the present invention is not limited to the specific embodiments described in this specification, except as defined in the appended claims.

What is claimed is:

1. A method of driving a display device, which interlace displays an image by dividing one frame into an odd-numbered field and an even-numbered field, and is used to display an intermediate gradation based on a combination of a plurality of light-emission blocks that emit light in respective predetermined light-emission pulses, comprising:

controlling a total number of light emission pulses within a field, based on a comparison of a first difference between a display load factor in a first field and a display load factor in a third field that is two fields before said first field and a second difference between the display load factor in said first field and a display load factor in a second field, which is only one field before said first field, wherein the display load factor is a value based on a result obtained by weighting and adding a number of lighting cells in each of the plurality of light-emission blocks of respective fields.

2. A method of driving a display device, which interlace displays an image by dividing one frame into an odd-numbered field and an even-numbered field, and is used to display an intermediate gradation based on a combination of a plurality of light-emission blocks that emit light in respective predetermined light-emission pulses, comprising:

comparing a first difference between a display load factor in a first field and a display load factor in a third field that is an even number of fields before said first field and a second difference between the display load factor in said first field and a display load factor in a second field, which is only one field before said first field; and controlling a total number of light-emission pulses within a field based on the comparison, wherein the display load factor is a value based on a result obtained by weighting and adding a number of lighting cells in each of the plurality of light-emission blocks of respective fields.

3. The method of driving a display device as claimed in claim 2, further comprising:

controlling a total number of light-emission pulses within a field, based on the display load factor in said second field when a difference between the perspective display load factors of said first and second fields does not exceed a threshold value.

4. The method of driving a display device as claimed in claim 3, wherein said second field is a current field and said first field is a next field.

5. The method of driving a display device as claimed in claim 2, wherein said driving method is used to display an intermediate gradation based on a combination of a plurality of light-emission blocks that emit light in respective, predetermined light-emission pulses.

6. A method of driving a display device, which interlace displays an image by dividing one frame into an odd-numbered field and an even-numbered field, and is used to display an intermediate gradation based on a combination of a plurality of light-emission pulses, comprising:

comparing a first difference between a display load factor in a first field and a display load factor in a third field that is two fields before said first field and a second difference between the display load factor in said first field and a display load factor in a second field, which is only one field before said first field; and controlling a total number of light-emission pulses within a field based on the comparison and values of the differences relative to a threshold value, wherein the display load factor is a value based on the result obtained by weighting and adding the number of lighting cells in each of plurality of light emission blocks of respective fields.

7. The method of driving a display device as claimed in claim 6, further comprising:

comparing the display load factor in said first field with a display load factor in said second field, when the difference between the respective display load factors of said first and third fields does not exceed the threshold value; and controlling a total number of light-emission pulses within a field, based on the display load factor in said second field when a difference between the respective display load factors of said first and second fields does not exceed a threshold value.

8. A method of driving a display device, which interlace displays an image by dividing one frame into an odd-numbered field and an even-numbered field, and is used to display an intermediate gradation based on a combination of a plurality of light-emission blocks that emit light in respective predetermined light-emission pulses, the method comprising:

calculating a first difference between a display load factor in a first field and a display load factor in a third field that is two fields before said first field, and controlling a total number of light-emission pulses within one field period, based on the display load factor in said first field, when the first difference exceeds a first threshold value;

calculating a second difference between the display load factor in said first field and a display load factor in a second field, which is only one field before said first field, when said first difference does not exceed said first threshold value, and controlling a total number of light-emission pulses within one field period, based on the display load factor in said second field, when said second difference does not exceed a second threshold value;

controlling a total number of light-emission pulses within one field period, based on the display load factor of said first field, when said first difference does not exceed said first threshold value and said second difference exceeds said second threshold value and the display load factor in said first field exceeds the display load factor in said second field; and controlling a total number of light-emission pulses within one field period, based on the display load factor in said second field, when said first difference does not exceed said first threshold and said second difference exceeds said second threshold value and the display factor in said second field does not exceed the display load factor in said second field.

9. The method of driving a display device according to claim 8, wherein the display load factor is a value based on a result obtained by weighting and adding a number of lighting cells in each of said plurality of light-emission blocks of said respective fields.

10. The method of driving a display device according to claim 8, wherein said second field is a current field, said first field is a next field, and said third field is a preceding field.

* * * * *